US009514699B2

(12) United States Patent
Li et al.

(10) Patent No.: US 9,514,699 B2
(45) Date of Patent: Dec. 6, 2016

(54) DEVICE AND METHOD FOR ADJUSTING GAMMA VOLTAGE

(71) Applicant: BOE TECHNOLOGY GROUP CO., LTD., Beijing (CN)

(72) Inventors: Shou Li, Beijing (CN); Chulgyu Jung, Beijing (CN); Yuxin Bi, Beijing (CN); Jiyang Shao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 139 days.

(21) Appl. No.: 14/447,954

(22) Filed: Jul. 31, 2014

(65) Prior Publication Data

US 2015/0279301 A1 Oct. 1, 2015

(30) Foreign Application Priority Data

Mar. 27, 2014 (CN) ..... 2014 1 0120681

(51) Int. Cl.
*G09G 3/36* (2006.01)

(52) U.S. Cl.
CPC ..... *G09G 3/3688* (2013.01); *G09G 2310/027* (2013.01); *G09G 2320/0673* (2013.01)

(58) Field of Classification Search
CPC combination set(s) only.
See application file for complete search history.

(56) References Cited

U.S. PATENT DOCUMENTS

2011/0141089 A1* 6/2011 Lee ..... G09G 3/20 345/211
2013/0249969 A1* 9/2013 Jeon ..... G09G 5/10 345/691

(Continued)

FOREIGN PATENT DOCUMENTS

CN 1834742 A 9/2006
CN 101419783 A 4/2009

(Continued)

OTHER PUBLICATIONS

Chinese Office Action dated Aug. 4, 2015 issued in Chinese Application No. 201410120681.5.

(Continued)

*Primary Examiner* — Jason Olson
*Assistant Examiner* — Sosina Abebe
(74) *Attorney, Agent, or Firm* — Nath, Goldberg & Meyer; Joshua B. Goldberg

(57) ABSTRACT

The present invention provides a device and a method for adjusting Gamma voltage. The device for adjusting Gamma voltage comprises a Gamma voltage generating unit used for generating a plurality of Gamma voltages, the Gamma voltage generating unit comprising a plurality of output terminals for outputting the plurality of Gamma voltages; and a plurality of output units, output terminals of each of which are connected to output terminals of a corresponding Gamma voltage generating circuit among a plurality of Gamma voltage generating circuits of the display panel to be adjusted in one-to-one correspondence, the plurality of output units being used for outputting the plurality of Gamma voltages to output terminals of the Gamma voltage generating circuits.

19 Claims, 2 Drawing Sheets

(56) References Cited

U.S. PATENT DOCUMENTS

| | | | | |
|---|---|---|---|---|
| 2014/0009506 | A1* | 1/2014 | Cheng | H03M 1/66 345/690 |
| 2014/0125646 | A1* | 5/2014 | Chu | G09G 3/3607 345/211 |
| 2015/0262537 | A1* | 9/2015 | Huang | G09G 3/3607 345/690 |

FOREIGN PATENT DOCUMENTS

| | | | |
|---|---|---|---|
| CN | 103325357 | A | 9/2013 |
| KR | 10-2006-0022147 | A | 3/2006 |
| KR | 20060022147 | A | 3/2006 |
| TW | 200519801 | A | 6/2005 |
| TW | 201243358 | A | 11/2012 |

OTHER PUBLICATIONS

Office Action dated Mar. 28, 2016 issued in corresponding Chinese Application No. 201410120681.5.

* cited by examiner

DEVICE AND METHOD FOR ADJUSTING GAMMA VOLTAGE

FIELD OF THE INVENTION

The present invention relates to the field of display technology, and particularly to a device and a method for adjusting Gamma voltage.

BACKGROUND OF THE INVENTION

Thin film transistor liquid crystal display (TFT-LCD), due to its advantages of high quality, excellent space utilization, low power consumption, no radiation, small volume and the like, has been widely used.

In image-displaying of TFT-LCD, a nonlinear relationship is presented between grayscale and luminance of a pixel, and a curve reflecting the nonlinear relationship is called Gamma curve, which is a power-law curve with a power-law index called Gamma value. In image-displaying of TFT-LCD, a Gamma voltage generating circuit of the TFT-LCD generates multiple Gamma voltages which are then converted to grayscale voltages which are used for displaying and correspond to respective grayscales. Since backlight luminance, panel materials and the like of different models of TFT-LCDs are not exactly the same, pixels with the same grayscale may present different luminance when the same Gamma voltage is applied, which results in differences between Gamma values of actual Gamma curves of some TFT-LCDs and a target Gamma value (generally is 2.2, and the corresponding curve thereof is referred to as 2.2 curve). The differences determine final displaying effects of the TFT-LCDs (i.e. the smaller the difference is, the better the displaying effect will be).

Therefore, it is necessary to adjust Gamma voltages of a TFT-LCD before the TFT-LCD leaves the factory, so that a Gamma curve whose Gamma value becomes as close to a target Gamma value (generally is 2.2) as possible is obtained and the obtained Gamma curve serves as a preset Gamma curve. As described above, Gamma voltages are generated by a Gamma voltage generating circuit comprising a timing controller, a Gamma IC and other components.

In adjusting Gamma voltages, the Gamma IC is controlled by a personal computer (PC) which is used for changing a Gamma voltage output by the Gamma IC. As for a certain grayscale, the Gamma IC outputs an initial Gamma voltage corresponding to the grayscale, detects pixel luminance under the condition of the initial Gamma voltage, and judges whether a relationship between the grayscale and the detected pixel luminance satisfies a power-law relationship with a power-law index of 2.2. If the power-law relationship is not satisfied, the Gamma IC adjusts the Gamma voltage, detects pixel luminance under the condition of the adjusted Gamma voltage and then judges whether a relationship between the grayscale and the detected pixel luminance satisfies the power-law relationship with the power-law index of 2.2. The above processes are repeated until a final Gamma voltage corresponding to the grayscale is found. Also, Gamma voltages corresponding to other grayscales are sequentially obtained in the same manner as above, thereby finishing adjusting Gamma voltages.

With the development of large-size display panel technology, two or more Gamma ICs are used in an increasing number of large-size display panels, that is, multiple Gamma ICs perform joint control to lighten all pixels.

Inventors found that at least the following problems exist in the prior art: for a display panel in which two or more Gamma ICs are used, when a process of adjusting Gamma voltage is performed thereon, in one aspect, multiple PCs may be used to control Gamma ICs, respectively, but in this case, the adjusting process becomes complicated and time-consuming; in another aspect, the Gamma ICs may be adjusted sequentially, but in this case the process of adjusting Gamma voltage cannot be performed on the entire display panel at the same time and thus an accurate Gamma curve of the entire display panel cannot be obtained through adjustment.

SUMMARY OF THE INVENTION

In terms of the problem that for a display panel in which multiple Gamma ICs are used, the process of adjusting Gamma voltages thereof is complex or an accurate Gamma curve of the entire display panel cannot be obtained through adjustment, an object of the present invention is to provide a device and a method for adjusting Gamma voltage so that the process of adjusting Gamma voltages of the display panel becomes simpler and an accurate Gamma curve of the entire display panel can be obtained through adjustment.

To achieve the above object, the technical solutions of the present invention include a device for adjusting Gamma voltage, which comprises a Gamma voltage generating unit used for generating a plurality of Gamma voltages, the Gamma voltage generating unit being provided with a plurality of output terminals for outputting the plurality of Gamma voltages; and a plurality of output units, output terminals of each of which are connected to output terminals of a corresponding Gamma voltage generating circuit among a plurality of Gamma voltage generating circuits of the display panel in one-to-one correspondence, the plurality of output units being used for outputting the plurality of Gamma voltages to output terminals of the Gamma voltage generating circuits.

In the device for adjusting Gamma voltage of the present invention, the Gamma voltage generating unit is capable of generating a plurality of Gamma voltages, the output units output the plurality of Gamma voltages generated by the Gamma voltage generating unit to the output terminals of the Gamma voltage generating circuits in the display panel to be adjusted (if the display panel includes a plurality of Gamma voltage generating circuits, the plurality of Gamma voltages are output to the output terminals of each of the plurality of Gamma voltage generating circuits of the display panel through the respective output units). In the display panel, the pixel units of the display panel are lightened by converted Gamma voltages. Subsequently, the grayscale and the luminance of pixel unit are analyzed so as to judge whether a relationship therebetween satisfies the power-law relationship with the target Gamma value. If the relationship therebetween satisfies power-law relationship with the target Gamma value, the Gamma voltage corresponding to the grayscale is obtained and the value of the obtained Gamma voltage corresponding to the grayscale is written into the Gamma voltage generating circuit of the display panel, thus finishing adjusting the Gamma voltage corresponding to the grayscale. Also, Gamma voltages corresponding to other grayscales may be obtained sequentially in the same manner, and the values of the obtained Gamma voltages corresponding to the other grayscales are written into the Gamma voltage generating circuits of the display panel, thus finishing adjusting the Gamma voltages. With the device for adjusting Gamma voltage of the present invention, the process of adjusting the Gamma voltages of the display panel is simple, and for the display panel in which multiple Gamma ICs are used, an accurate Gamma curve of the entire display panel can be obtained through adjustment.

Preferably, the device for adjusting Gamma voltage of the present invention further comprises an operational amplifying unit with input terminals connected to the Gamma voltage generating unit and output terminals connected to the plurality of output units, and the operational amplifying unit is used for amplifying the plurality of Gamma voltages output from the Gamma voltage generating unit and supplying the amplified Gamma voltages to each of the output units.

Preferably, the device for adjusting Gamma voltage further comprises a control unit used for controlling the Gamma voltage generating unit so as to change the Gamma voltages generated by the Gamma voltage generating unit.

Preferably, the Gamma voltage generating unit includes a Gamma IC.

Further preferably, the Gamma IC is provided with 14 or 18 channels for outputting different Gamma voltages.

Preferably, the operational amplifying unit includes an operational amplifier.

Further preferably, the number of channels of the operational amplifier is the same as that of the output terminals of the Gamma voltage generating unit.

Still further preferably each of the output units includes a port output connector, and output terminals of each port output connector are connected to output terminals of a corresponding Gamma voltage generating circuit of the display panel.

Still further preferably, the number of channels of each port output connector is the same as that of the output terminals of the Gamma voltage generating unit, and the same channels of the respective port output connectors are connected in parallel with each other.

The technical solutions used to solve the above problems include a method for adjusting Gamma voltage, comprising:

step 1, generating a plurality of Gamma voltages by a Gamma voltage generating unit:

step 2, outputting the plurality of Gamma voltages to output terminals of a plurality of Gamma voltage generating circuits of a display panel to be adjusted in one-to-one correspondence by a plurality of output units:

step 3, converting the plurality of Gamma voltages output from the plurality of output units so as to generate grayscale voltages, and lightening pixel units of the display panel through the grayscale voltages; and step 4, judging whether a predetermined relationship is satisfied between a grayscale and luminance of a pixel unit of the display panel if not, returning to step 1 and adjusting the Gamma voltage, and if so, writing a value of the Gamma voltage into the Gamma voltage generating circuit of the display panel.

Preferably, between the step 1 and the step 2, the method further comprises a step of:

amplifying the plurality of Gamma voltages generated by the Gamma voltage generating unit by an operational amplifying unit, and supplying the amplified Gamma voltages to each of the plurality of output units, respectively.

Preferably, in the step 1, the Gamma voltage generating unit generates a plurality of desired Gamma voltages under the control of a control unit.

In the method for adjusting Gamma voltage of the present embodiment, the device for adjusting Gamma voltage described above is used to adjust Gamma voltages of the display panel, the adjusting process is simple and the method may be suitable for the display panel in which multiple Gamma ICs are used, thereby being highly adaptable.

DETAILED DESCRIPTION OF THE EMBODIMENTS

To give a better understanding of technical solutions of the present invention for those skilled in the art, the present invention will be further described in details in conjunction with the accompanying drawings and specific implementations. Apparently, the embodiments to be described are only a part but not all of the embodiments. Other embodiments which, based on the embodiments to be described, are obtained by those skilled in the art without creative effort fall into the protection scope of the present invention.

Embodiment 1

The present embodiment provides a device for adjusting Gamma voltage, which is used for adjusting Gamma voltages of a display panel. The device for adjusting Gamma voltage provided by this embodiment especially suitable for a display panel with multiple Gamma ICs therein. Said display panel may be a liquid crystal display panel, an OLED display panel or other types of display panels.

Figure 1:
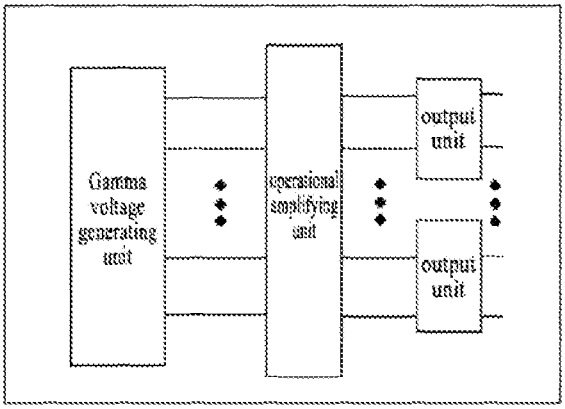
FIG. 1 is a block diagram of a structure of a device for adjusting Gamma voltage according to Embodiment 1 of the present invention.
Figure 2:
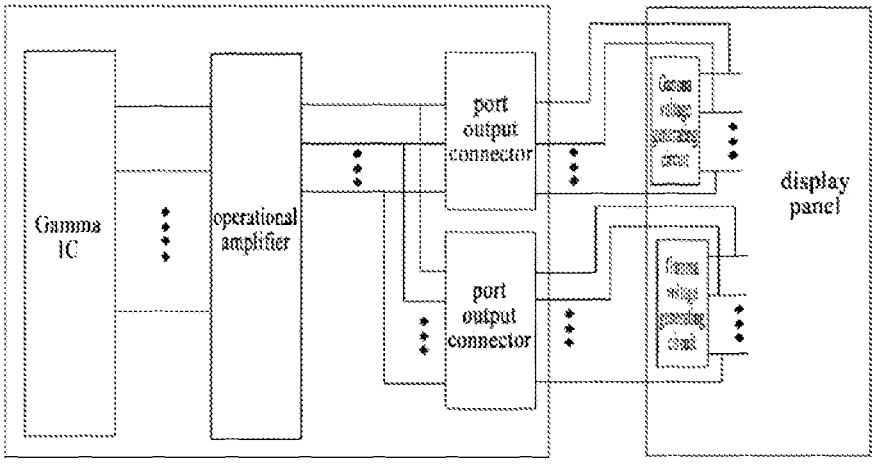
FIG. 2 is a schematic diagram illustrating a connection between a device for adjusting Gamma voltage according to Embodiment 1 of the present invention and a Gamma voltage generating circuit of a display panel to be adjusted.

FIG. 1 illustrates a structure of a device for adjusting Gamma voltage according to the present embodiment, and FIG. 2 illustrates a connection between a device for adjusting Gamma voltage according to the present embodiment and a Gamma voltage generating circuit of a display panel to be adjusted. As illustrated in FIG. 1, the device for adjusting Gamma voltage of the present embodiment comprises: a Gamma voltage generating unit for generating a plurality of Gamma voltages and provided with a plurality of output terminals for outputting the plurality of Gamma voltages; and a plurality of output units (two output units are illustrated in FIG. 1, and the number of the output units is consistent with that of Gamma voltage generating circuit of the display panel to be adjusted), and output terminals of each output unit are connected to output terminals of a corresponding Gamma voltage generating circuit among a plurality of Gamma voltage generating circuits of the display panel to be adjusted in one-to-one correspondence, the output units being used for outputting the plurality of Gamma voltages generated by the Gamma voltage generating unit to the output terminals of the plurality of Gamma voltage generating circuits of the display panel to be adjusted (if the display panel to be adjusted includes a plurality of Gamma voltage generating circuits, for example, two Gamma voltage generating circuits as illustrated in FIG. 2, the plurality of Gamma voltages are output from the plurality of output units to respective output terminals of the plurality of Gamma voltage generating circuits of the display panel). Obviously, the device for adjusting Gamma voltage in the present embodiment should comprise other well-known structures such as DC converter, input terminals and the like, which are not elaborated herein. A pixel unit of the display panel is lightened through a grayscale voltage converted from a Gamma voltage. Further, based on judgment whether a power-law relationship with a target Gamma value (generally, is 2.2) is satisfied between the grayscale and the luminance of the pixel unit, the Gamma voltage of the display panel is adjusted.

Preferably, the device for adjusting Gamma voltage of the present embodiment further comprises an operational amplifying unit with input terminals connected to the Gamma voltage generating unit and output terminals connected to the respective output units. The operational amplifying unit is used for amplifying the plurality of Gamma voltages output from Gamma voltage generating unit, and supplying the amplified Gamma voltages to each of the output units. The Gamma voltages which are amplified by the operational amplifying unit after being output from the Gamma voltage generating unit have improved load capacity, and thus can output more stable Gamma voltages.

Preferably, the device for adjusting Gamma voltage further comprises a control unit (not shown) which is used for controlling the Gamma voltage generating unit so as to change the Gamma voltages generated by the Gamma voltage generating unit. With the control unit, Gamma voltages with different values may be output from the Gamma voltage generating unit, so that the pixel units of the display panel may present different luminance. The control unit may be a PC which is connected to the Gamma voltage generating unit via an input port such as a USB port and changes output values of the Gamma voltage generating unit in conjunction with software control. The control unit may also be a control circuit in another form, as long as the control circuit is capable of changing output values of the Gamma voltage generating unit.

Preferably, the Gamma voltage generating unit includes a Gamma IC.

Further preferably, the Gamma IC is provided with 14 or 18 channels for outputting different Gamma voltages. Specifically, the Gamma IC may be a programmable Gamma IC, which generates voltages with low error and high accuracy.

Preferably, the operational amplifying unit includes an operational amplifier.

Further preferably, the number of channels of the operational amplifier is equal to that of the output terminals of the Gamma voltage generating unit. That is, in the case that the Gamma voltage generating unit is the Gamma IC provided with 14 or 18 channels, the number of the channels of the operational amplifier is also 14 or 18. The operational amplifier is a circuit unit with a large amplification factor, and in the present embodiment, the amplification factor for the Gamma voltages may be determined according to the actual conditions.

Still further preferably, each of the output units includes a port output connector, as illustrated in FIG. 2. That is, the device for adjusting Gamma voltage comprises a plurality of port output connectors.

Still further preferably, among the plurality of port output connectors, output terminals of one port output connector are connected to output terminals of one corresponding Gamma voltage generating circuit of the display panel to be adjusted. FIG. 2 illustrates a case in which output terminals of two port output connectors are connected to output terminals of two Gamma voltage generating circuits of the display panel to be adjusted, respectively. The number of channels of each port output connector is the same as that of the output terminals of the Gamma voltage generating unit, that is, in the case that the Gamma voltage generating unit is a Gamma IC provided with 14 or 18 channels, each port output connector is provided with 14 or 18 channels and the channels in respective port output connectors outputting the same signal, hereinafter referred to as the same channels, are connected in parallel with each other. In other words, the voltage signals of the same channels of the respective port output connectors are connected together, and in this way, the voltage signals output from the same channels of the respective port output connectors synchronize with each other so that the pixel units of the display panel can be lightened simultaneously.

In the present embodiment, the Gamma IC, the operational amplifier and the port output connector have the same number of channels which is 14 or 18, and in this way, the circuit has simple connection, and the device for adjusting Gamma voltage has a simple structure, thereby facilitating manufacture of the device for adjusting Gamma voltage. It can be understood that the Gamma IC, the operational amplifier and the port output connector may have different numbers of channels, and in this case the circuit has complex connection.

In the device for adjusting Gamma voltage of the present invention, the Gamma voltage generating unit is capable of generating a plurality of Gamma voltages, the output units output the plurality of Gamma voltages generated by the Gamma voltage generating unit to output terminals of the Gamma voltage generating circuits in the display panel to be adjusted. In the display panel, the Gamma voltages drive pixel units after being converted, and lighten the pixel units of the display panel. Subsequently, the grayscale and the luminance of pixel units are analyzed so as to judge whether a relationship therebetween satisfies the power-law relationship with the target Gamma value. If the relationship therebetween satisfies the power-law relationship with the target Gamma value, the Gamma voltage corresponding to the grayscale is obtained and the value of the obtained Gamma voltage corresponding to the grayscale is written into the Gamma voltage generating circuit of the display panel, thus finishing adjusting the Gamma voltage corresponding to the grayscale. Also, Gamma voltages corresponding to other grayscales may be obtained in the same manner, and the values of the obtained Gamma voltages corresponding to the other grayscales are written into the Gamma voltage generating circuits of the display panel, thus finishing adjusting the Gamma voltages. With the device for adjusting Gamma voltage of the present invention, the process of adjusting the Gamma voltages of the display panel is simple, and for the display panel in which multiple Gamma ICs are used, an accurate Gamma curve of the entire display panel can be obtained.

Embodiment 2

Figure 3:
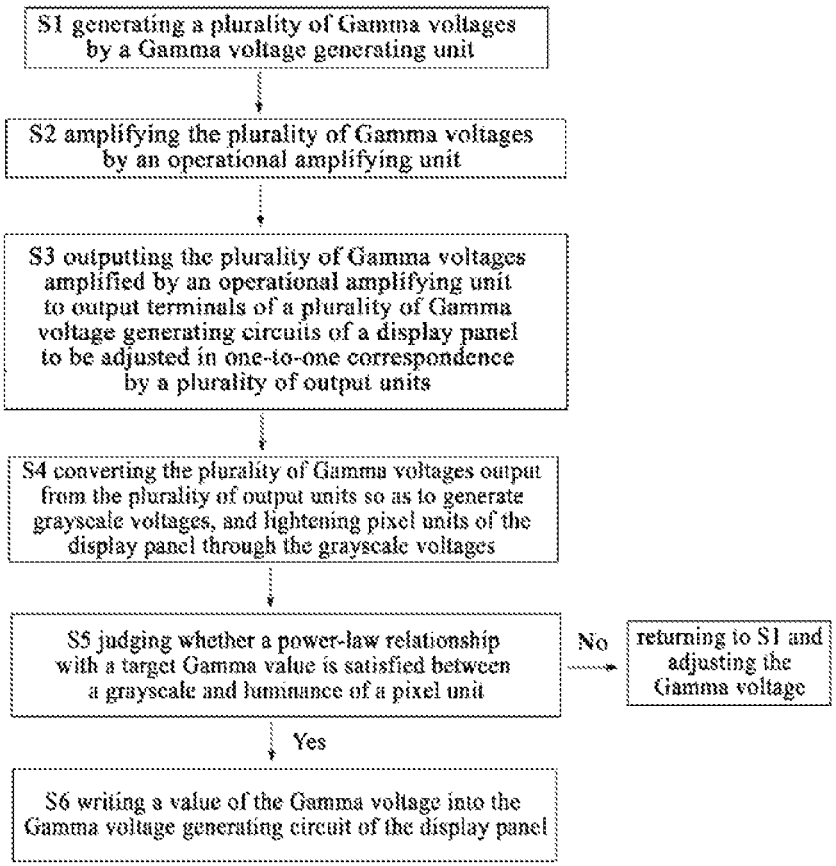
FIG. 3 is a flowchart of a method for adjusting Gamma voltage according to Embodiment 2 of the present invention.

The present embodiment provides a method for adjusting Gamma voltage, which is used for adjusting Gamma voltages of a display panel by using the device for adjusting Gamma voltage in Embodiment 1. Referring to FIGS. 1 to 3, the method for adjusting Gamma voltage comprises steps of:

step 1, generating a plurality of Gamma voltages by the Gamma voltage generating unit;

Preferably, when the device for adjusting Gamma voltage comprises a control unit, in step 1, a plurality of desired Gamma voltages are generated by the Gamma voltage generating unit under the control of the control unit.

step 2, preferably, amplifying the plurality of Gamma voltages by the operational amplifying unit to improve load capacity of the Gamma voltages, and supplying the amplified Gamma voltages to each of the plurality of output units, respectively;

step 3, outputting the plurality of Gamma voltages amplified by the operational amplifying unit to the output terminals of the plurality of Gamma voltage generating circuits of the display panel to be adjusted in one-to-one correspondence by the plurality of output units;

step 4, converting the plurality of Gamma voltages output from the plurality of output units so as to generate grayscale voltages, and lightening pixel units of the display panel through the grayscale voltages;

Specifically, in step 4, grayscale voltages are generated after the Gamma voltages are converted by a D/A converter in a source driving circuit, and pixel units on the display panel are lightened through the grayscale voltages.

step 5, judging whether a predetermined relationship is satisfied between the grayscale and luminance of the pixel unit of the display panel; in the present embodiment, taking the case in which the predetermined relationship is a power-law relationship with a target Gamma value (generally, is 2.2) as an example, if the power-law relationship with the target Gamma value is satisfied, writing the Gamma voltage into the Gamma voltage generating circuit of the display panel; if the power-law relationship with the target Gamma value is not satisfied, returning to step 1, adjusting the Gamma voltage and repeating the above steps until the power-law relationship with the target Gamma value is satisfied between the grayscale and luminance of the pixel units, so as to obtain the Gamma voltage value corresponding to the grayscale.

According to the above method, Gamma voltages corresponding to respective grayscales are sequentially obtained, and the values of the obtained Gamma voltages corresponding to respective grayscales are written into the Gamma voltage generating circuits of the display panel, thus finishing adjusting Gamma voltages of the display panel.

In the method for adjusting Gamma voltage of the present embodiment, the device for adjusting Gamma voltage in Embodiment 1 is used to adjust Gamma voltages of the display panel, the adjusting process is simple and the method may be suitable for the display panel in which multiple Gamma ICs are used, thereby being highly adaptable.

It can be understood that the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as the protection scope of the present invention.

The invention claimed is:

1. A device for adjusting Gamma voltage, used for adjusting Gamma voltages of a display panel, comprising a Gamma voltage generating unit used for generating a plurality of Gamma voltages, the Gamma voltage generating unit being provided with a plurality of output terminals for outputting the plurality of Gamma voltages; and a plurality of output units, output terminals of each of which are connected to output terminals of a corresponding Gamma voltage generating circuit among a plurality of Gamma voltage generating circuits of the display panel in one-to-one correspondence, the plurality of output units being used for outputting the plurality of Gamma voltages to output terminals of the Gamma voltage generating circuits.

2. The device for adjusting Gamma voltage according to claim 1, further comprising an operational amplifying unit with input terminals connected to the Gamma voltage generating unit and output terminals connected to the plurality of output units, the operational amplifying unit used for amplifying the plurality of Gamma voltages output from the Gamma voltage generating unit and supplying the amplified Gamma voltages to each of the output units.

3. The device for adjusting Gamma voltage according to claim 1, further comprising a control unit used for controlling the Gamma voltage generating unit so as to change the Gamma voltages generated by the Gamma voltage generating unit.

4. The device for adjusting Gamma voltage according to claim 2, further comprising a control unit used for controlling the Gamma voltage generating unit so as to change the Gamma voltages generated by the Gamma voltage generating unit.

5. The device for adjusting Gamma voltage according to claim 1, wherein, the Gamma voltage generating unit includes a Gamma IC.

6. The device for adjusting Gamma voltage according to claim 2, wherein, the Gamma voltage generating unit includes a Gamma IC.

7. The device for adjusting Gamma voltage according to claim 3, wherein, the Gamma voltage generating unit includes a Gamma IC.

8. The device for adjusting Gamma voltage according to claim 5, wherein, the Gamma IC is provided with 14 or 18 channels for outputting different Gamma voltages.

9. The device for adjusting Gamma voltage according to claim 2, wherein, the operational amplifying unit includes an operational amplifier.

10. The device for adjusting Gamma voltage according to claim 4, wherein, the operational amplifying unit includes an operational amplifier.

11. The device for adjusting Gamma voltage according to claim 6, wherein, the operational amplifying unit includes an operational amplifier.

12. The device for adjusting Gamma voltage according to claim 9, wherein, the number of channels of the operational amplifier is the same as that of the output terminals of the Gamma voltage generating unit.

13. The device for adjusting Gamma voltage according to claim 10, wherein, the number of channels of the operational amplifier is the same as that of the output terminals of the Gamma voltage generating unit.

14. The device for adjusting Gamma voltage according to claim 1, wherein, each of the output units includes a port output connector, and output terminals of each port output connector are connected to output terminals of a corresponding Gamma voltage generating circuit of the display panel.

15. The device for adjusting Gamma voltage according to claim 14, wherein, the number of channels of each port output connector is the same as that of the output terminals of the Gamma voltage generating unit, and the same channels of the respective port output connectors are connected in parallel with each other.

16. A method adjusting Gamma voltage, comprising:

step 1, generating a plurality of Gamma voltages by a Gamma voltage generating unit;

step 2, outputting the plurality of Gamma voltages to output terminals of a plurality of Gamma voltage generating circuits of a display panel to be adjusted in one-to-one correspondence by a plurality of output units;

step 3, converting the plurality of Gamma voltages output from the plurality of output units so as to generate grayscale voltages, and lightening pixel units of the display panel with the grayscale voltages; and step 4, judging whether a predetermined relationship is satisfied between a grayscale and luminance of a pixel unit of the display panel, if not, returning to step 1 and adjusting the Gamma voltage, and if so, writing a value of the Gamma voltage into the Gamma voltage generating circuit of the display panel.

17. The method for adjusting Gamma voltage according to claim 16, wherein, between the step 1 and the step 2, further comprising a step of:

amplifying the plurality of Gamma voltages generated by the Gamma voltage generating unit by an operational amplifying unit, and supplying the amplified Gamma voltages to each of the plurality of output units, respectively.

18. The method for adjusting Gamma voltage according to claim 16, wherein, in the step 1, the Gamma voltage generating unit generates a plurality of desired Gamma voltages under the control of a control unit.

19. The method for adjusting Gamma voltage according to claim 17, wherein, in the step 1, the Gamma voltage generating unit generates a plurality of desired Gamma voltages under the control of a control unit.

* * * * *